US005403965A

United States Patent [19]

Matsuda et al.

[11] Patent Number: 5,403,965

[45] Date of Patent: Apr. 4, 1995

[54] SEQUENCER HAVING A REDUCED NUMBER OF PANEL SWITCHES

[75] Inventors: Tasuya Matsuda, Hamamatsu; Toshinori Matsuda, Shizuoka, both of Japan

[73] Assignee: Kabushiki Kaisha Kawai Gakki Seisakusho, Hamamatsu, Japan

[21] Appl. No.: 993,185

[22] Filed: Dec. 18, 1992

[30] Foreign Application Priority Data

Mar. 6, 1992 [JP] Japan ..... 4-082908
Mar. 6, 1992 [JP] Japan ..... 4-082909

[51] Int. Cl.[6] ..... G10H 7/00; G04B 13/00; A63H 5/00

[52] U.S. Cl. ..... 84/609

[58] Field of Search ..... 84/609–614, 84/634, 635, 645

[56] References Cited

U.S. PATENT DOCUMENTS

| | | | |
|---|---|---|---|
| 4,930,390 | 6/1990 | Kellogg et al. | 84/611 |
| 4,969,384 | 11/1990 | Kawasaki et al. | 84/612 |
| 4,993,306 | 2/1991 | Ueta et al. | 84/601 |
| 5,164,529 | 11/1992 | Saito | 84/612 |
| 5,225,618 | 7/1993 | Wadhams | 84/602 |
| 5,225,620 | 7/1993 | Terada | 84/609 |
| 5,300,723 | 4/1994 | Ito | 84/601 |
| 5,300,725 | 4/1994 | Manabe | 84/609 |
| 5,347,082 | 9/1994 | Ojima | 84/609 |

*Primary Examiner*—William M. Shoop, Jr.
*Assistant Examiner*—Jeffrey W. Donels
*Attorney, Agent, or Firm*—Joseph C. Mason, Jr.; Ronald E. Smith

[57] ABSTRACT

A sequencer according to the present invention comprises: an interface circuit for exchanging externally supplied play data; a memory for storing received play data; and a panel switch for generating a signal that indicates a recording start. Recording is performed when, in response to a recording start signal from the panel switch, the sequencer, using predetermined data, automatically generates storage location data, and stores play data at the storage location designated by the storage location data.

A sequencer according to the present invention further comprises: a memory for storing play data corresponding to multiple musical pieces; an interface circuit for outputting play data that is read from the memory; and a panel switch for indicating continuous reproduction. Upon the depression of the panel switch, the sequencer sequentially reads a predetermined quantity of play data from the head of each musical piece that is stored in the memory and reproduces musical tones using that play data. Then, when the panel switch is again depressed, the sequencer reads the remainder of the play data for the musical piece currently being read-out and reproduces that musical piece.

16 Claims, 10 Drawing Sheets

| | | |
|---|---|---|
| MUSICAL PIECE IDENTIFICATION NUMBER | 1 | 1 |
| | 2 | 1 |
| | 3 | 0 |
| | ⋮ | 0 |
| | ⋮ | ⋮ |
| MUSICAL PIECE IDENTIFICATION NUMBER | 100 | 0 |

0 : UNUSED
1 : IN USE

Fig. 9

| FLAG VALUE | OPERATION MODE | OPERATION |
|---|---|---|
| 0 | STANDBY MODE | ON STANDBY |
| 1 | REPRODUCTION MODE | REPRODUCING |
| 2 | SEARCH AND REPRODUCTION MODE | SEARCHING AND REPRODUCING |
| 3 | RECORDING MODE | RECORDING |
| 4 | AUTO SONG 2 RECORDING MODE | RECORDING AUTO SONG 2 |

Fig. 10

SEQUENCER HAVING A REDUCED NUMBER OF PANEL SWITCHES

BACKGROUND OF THE INVENTION

1. Field of the Invention

The present invention relates to a sequencer that records the play data produced when an electronic musical instrument, such as an electronic piano or an electronic organ, is played, and that retrieves the recorded play data. More particularly, the present invention pertains to a sequencer, for an electronic musical instrument, that easily performs the recording and the retrieval of play data.

2. Description of the Related Art

Recently, electronic musical instrument techniques have reached a high level of development; accordingly, electronic musical instruments with advanced functions and performance are available. For example, electronic musical instruments are being manufactured that can exchange play data with external devices via interfaces that conform to the industry standards for MIDI (Musical Instrument Digital Interface), etc.

One external device that is designed to exchange play data with an electronic musical instrument and that is in practical use is a sequencer that stores the play data that is produced when an electronic musical instrument is played, and that reads recorded play data and feeds it to an electronic musical instrument that thereafter reproduces musical tones.

Since to set up such a sequencer to record play data, or to retrieve recorded play data, various switches must be used, a desirable sequencer is one for which only simple, uncomplicated operations are required to prepare it for the recording and retrieving of data.

A conventional sequencer employs a storage medium, such as a Random Access Memory (RAM), a magnetic tape, or a magnetic disk, to store play data that is received from an external device.

The recording surface of this storage medium is divided into a number of storage areas to store the play data that correspond to musical pieces, and multiple musical pieces can be stored therein. The storage areas of the storage medium are identified by individual numbers, "musical piece identification numbers." To record and retrieve play data, a desired storage area is selected by using a musical piece identification number.

Each of the storage areas is subdivided in turn into a number of tracks, e.g., 16 tracks, and a different type of play data is recorded along each track in a storage area.

For a sequencer that is arranged as above to record play data, several discrete operations are required. Specifically, to designate a data recording location, a desired musical piece identification number (storage area) must be selected by using a specific switch, and then a desired track must be selected by using another switch. Thereafter, upon the depression of the switch to begin recording, the sequencer is set to a recording mode, and play data, which is produced as an electronic musical instrument is played, is input to the sequencer and recorded in the storage area specified by the musical piece identification number and the track.

Because, as described above, a musical piece identification number and a track have to be selected before play data can be recorded, the operation of a conventional sequencer is complicated.

Also, as an operator must remember which musical piece identification numbers (storage areas) and tracks in the storage medium are already in use, so as to select an unused musical piece identification number and an unused track for the recording of data, a conventional sequencer is not easy to operate.

Further, for a sequencer arranged as above to retrieve play data, several other discrete operations are required. Specifically, a desired musical piece identification number (storage area) must be selected by using a specific switch, and a reproduction switch must be depressed. Then, play data, which is stored on all the tracks of the storage area specified by the musical piece number, is sent to, for example, an electronic musical instrument, which thereafter reproduces musical tones.

In this case, if a timbre was not specified and designated by "timbre number data" when recording, the reproduced musical tones have the initial timbre that is set in the sequencer. To reproduce musical tones having a desired timbre, a discrete operation must be performed to add timbre number data to the head of the recorded play data when recording, a very troublesome necessity.

Finally, when a desired musical piece is being selected for reproduction but the exact musical piece identification number is not known, the musical piece identification numbers in use must be scanned sequentially, i.e., each musical piece identification number must be selected and a reproduction switch must be depressed, until the desired musical piece is found. The time expended during such a search process degrades operational efficiency.

SUMMARY OF THE INVENTION

To overcome these shortcomings, it is the first object of the present invention to provide a highly efficient sequencer that requires the performance of only a simple, uncomplicated operational procedure to select a storage destination for play data when recording.

It is the second object of the present invention to provide a sequencer that employs a simplified search operation to locate a desired musical piece when reproducing.

It is the third object of the present invention to provide a sequencer that supplies a desired timbre for a musical piece during reproduction even though timbre number data was not designated when recording.

To achieve the first object, a sequencer according to the present invention comprises:

- interface means for receiving and transmitting externally supplied play data;
- instructing means for generating a signal indicating a recording start;
- control means, connected to the interface means and the instructing means, for, upon reception from the instructing means of the signal indicating a recording start, using predetermined data to automatically produce and output data designating a storage location for play data sent from the interface means, and for outputting the play data received from the interface means; and
- storage means, connected to the control means, for storing the play data output by the control means.

According to the present invention, when the instructing means sends an instruction, the sequencer bases the selection of a storage location for externally supplied play data on predetermined data, rather than, as is done conventionally, on data input by the manipulation of switches. The predetermined data used are, for example, specified data included in externally supplied play data, data that are stored in a table which is used for managing unused areas, etc.

As predetermined data are used to select a location in the storage means for storing externally supplied play data, certain switch operations are eliminated. And since selecting the storage location for play data and starting recording are accomplished simply by employing the instructing means, a sequencer with reduced operational complexity can be provided.

To achieve the second object, a sequencer according to the present invention comprises:

storage means for storing play data corresponding to multiple musical pieces;

instructing means for generating a signal indicating continuous reproduction;

control means, connected to the storage means and the instructing means, for, upon reception from the instructing means of a signal indicating continuous reproduction, sequentially reading a predetermined quantity of play data from the head of each of the multiple musical pieces stored in the storage means and outputting the play data, and for, upon reception from the instructing means of another signal indicating continuous reproduction, reading and outputting the remainder of the play data for a musical piece that is in process of being read; and interface means, connected to the control means, for transmitting the play data to an external device.

According to the present invention, in response to an instruction by the instructing means, the sequencer reads part of the head of the play data for each musical piece that is stored in the storage means and outputs that data in sequential order for musical reproduction. When a second instruction is sent by the instructing means, the sequencer performs a normal reproduction process based on the remainder of the play data for a musical piece that is in the process of being read.

An operator does not have to select a desired musical piece each time before reproducing it, and a sequencer can be provided that facilitates operations by easily and quickly selecting and reproducing a desired musical piece.

To achieve the third object, a sequencer according to the present invention comprises:

interface means for receiving and transmitting externally supplied play data;

instructing means for generating a signal indicating a recording start;

control means, connected to the interface means and the instructing means, for, upon reception from the instructing means of a signal indicating a recording start, using data for a timbre number included in the play data to automatically produce and output data for a storage location for play data sent from the interface means, and for outputting play data to designate a timbre corresponding to the data for a timbre number and sequentially outputting the play data sent from the interface means; and storage means, connected to the control means, for storing the play data transmitted by the control means to designate a timbre, and the play data transmitted by the interface means, based on the data for a storage location transmitted by the control means.

The sequencer of the present invention allocates a timbre to the individual storage areas, for example, the individual tracks, in the storage means for recording play data. When play data is supplied by an external device, the sequencer records play data that designates a timbre, e.g., timbre number data, along a track where the play data should be recorded in consonance with produced storage location data, and sequentially records play data that is supplied by an external device.

As a result, even if timbre number data is not designated using a discrete operational procedure when recording, a musical piece can be reproduced with a desired timbre.

BRIEF DESCRIPTION OF THE DRAWINGS

FIG. 9 is a diagram illustrating one example of the arrangement of a recording table that is used in the embodiment of the present invention; and FIG. 10 is a diagram showing how the flags and operation modes that are used in the embodiment of the present invention are related.

DETAILED DESCRIPTION OF THE PREFERRED EMBODIMENT

Figure 1:
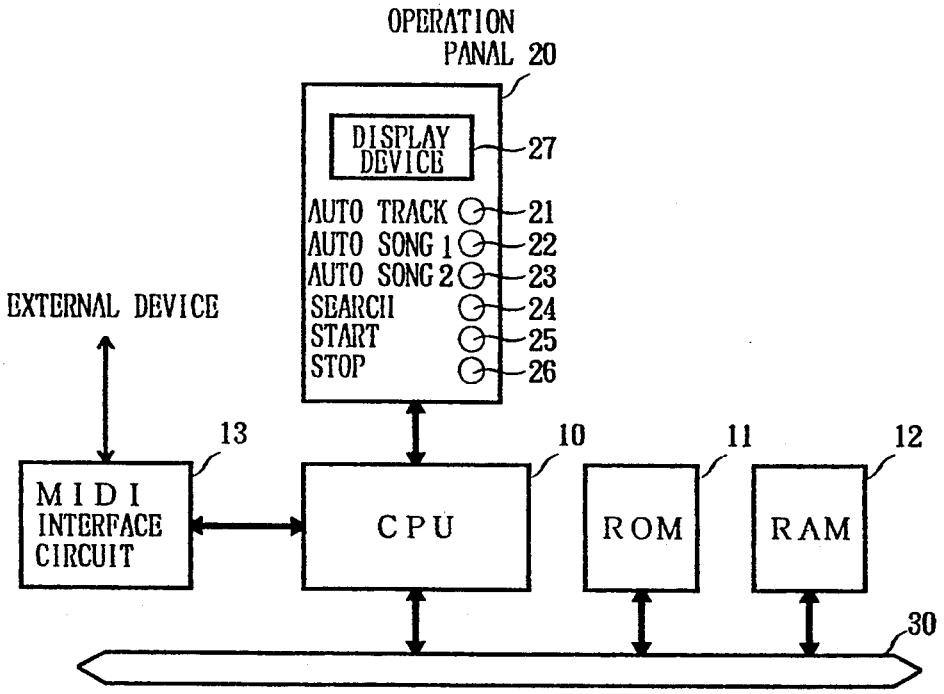
FIG. 1 is a schematic block diagram illustrating the general structure of one embodiment of a sequencer according to the present invention.

The preferred embodiment of the present invention will now be described while referring to the accompanying drawings. FIG. 1 is a schematic block diagram illustrating the general arrangement of one embodiment of a sequencer according to the present invention.

In FIG. 1, a central processing unit (CPU) 10 controls the individual sections of the sequencer by executing the instructions included in a control program that is stored in a read only memory (ROM) 11.

In the ROM 11, besides the control program, various datum constants to be used by the CPU 10 are stored. The ROM 11 is accessed by the CPU 10 through a system bus 30.

In a random access memory (RAM) 12 are defined a work area for the CPU 10, and various tables, registers, flags, etc. that are used to control the sequencer. Also located in the RAM 12 is a storage area for recording play data that is supplied from an external device.

In this embodiment, this storage area is subdivided into storage sectors and such storage sectors are allocated unique musical piece identification numbers, 1 through 100.

Among the flags defined in the RAM 12 is a flag for describing the operation mode of the sequencer. The relation between the value of the flag and the operation mode is shown in FIG. 10.

The above described RAM 12 is accessed by the CPU 10 through the system bus 30.

A MIDI interface circuit 13 is disposed between an external device (not shown) and the CPU 10 for the exchange of play data. The external device employed in this case is an electronic musical instrument, such as an electronic piano, an electronic organ, or an electronic keyboard, that incorporates a MIDI interface function, and that supplies play data to the sequencer and produces musical tones based on play data it receives from the sequencer.

The MIDI interface circuit 13 is connected directly to the CPU 10, i.e., without using the system bus 30.

An operation panel 20 has an auto track switch 21, an auto song 1 switch 22, an auto song 2 switch 23, a search switch 24, a start switch 25, a stop switch 26 and a display device 27. Note that in FIG. 1 only those components are shown that are necessary to explain the present invention.

The auto track switch 21 is used to instruct a recording start following the automatic selection of a track along which play data from an external device should be recorded.

The auto song 1 switch 22 is employed to instruct a recording start following the automatic selection of a musical piece identification number and a track for recording play data from an external device.

The auto song 2 switch 23 is used to instruct the temporary recording of externally supplied play data following the automatic selection of a musical piece identification number and a track, and to store temporarily recorded play data in a musical piece identification number in an interactive mode which will be described later.

The search switch 24 is used to read several measures of recorded play data in a predetermined order.

The start switch 25 is employed to start retrieval and to designate a musical piece identification number where temporarily recorded play data is stored when an auto song 2 function is used.

The stop switch 26 is used to stop the current operation and to shift to a standby mode, and to change and to display a musical piece identification number when the auto song 2 function is used.

The ON/OFF states of the individual switches on the operation panel 20 are detected by a scan circuit (not shown) and are sent to the CPU 10. The ON/OFF state data is stored ill a predetermined area of the RAM 12 and is referred to when an event map, to be described later, is prepared.

The display device 27 is constituted by, for example, an LCD, and is used to display the various states of the sequencer, and messages. In this case, for example, the display device 27 is used to display musical piece identification numbers that can be selected. The display on the display device 27 is controlled by data sent from the CPU 10.

The CPU 10, the ROM 11, and the RAM 12 are mutually connected by the system bus 30.

With such an arrangement, the operation of the embodiment will now be explained while referring to the flowcharts shown in FIGS. 2 to 8.

Figure 2:
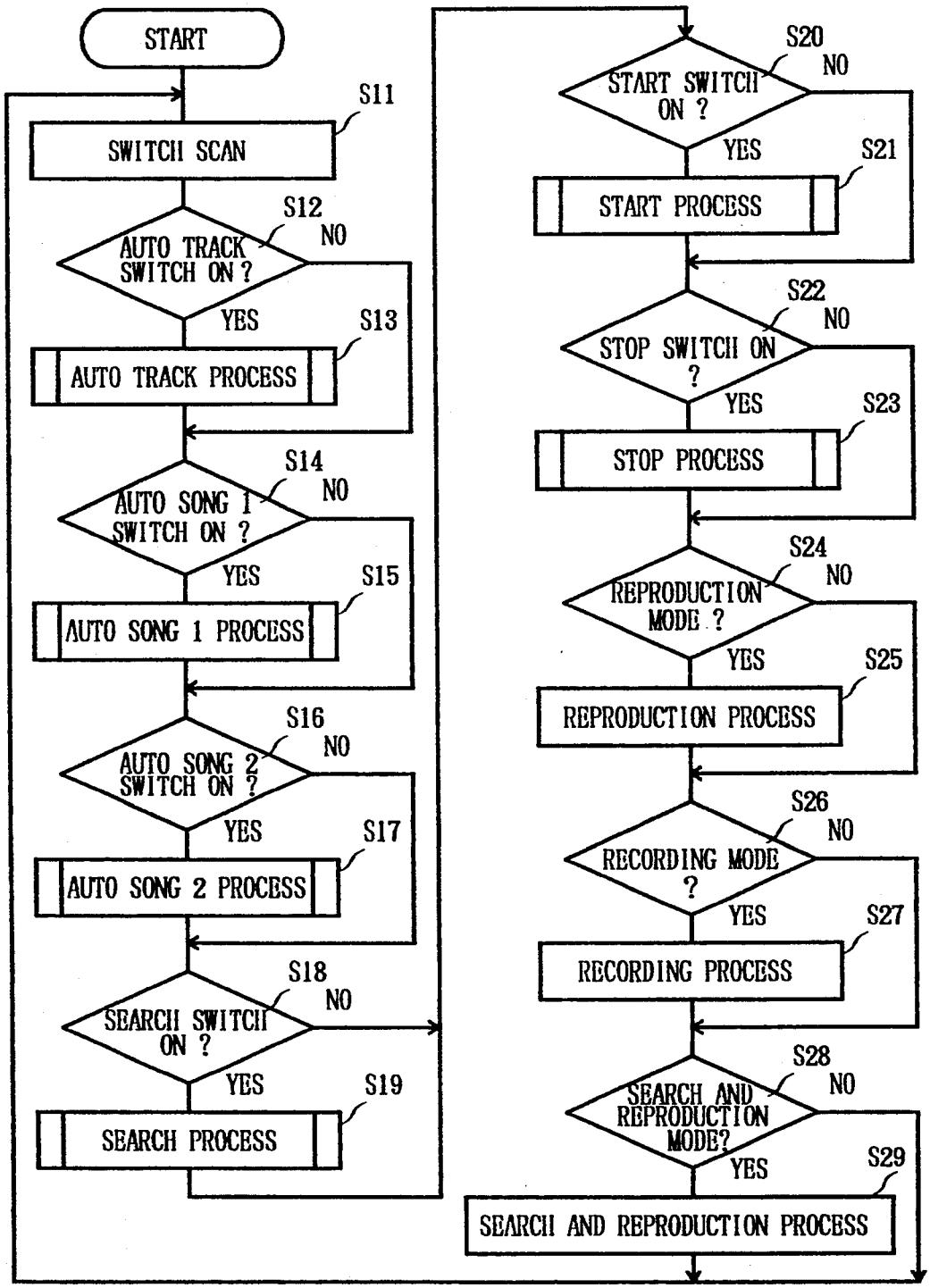
FIG. 2 is a flowchart for explaining the general operation of the embodiment of the present invention.

The flowchart in FIG. 2 graphically describes the general processing for this embodiment of the sequencer.

When a reset signal is produced at power on, or upon the depression of a reset switch (not shown), the sequencer is first initialized, and then execution of the, processing program is begun.

In the sequencer processing, a switch scan process is performed first (step S11). During this process, the switch ON/OFF state data detected by the scan circuit (not shown) of the operation panel 20 is fetched by the CPU 10. This data is compared with the previously fetched ON/OFF state data, stored in a predetermined area of the RAM 12, and an ON event map, wherein a bit is set that corresponds to a switch that has been newly set to the ON state, is prepared in the RAM 12.

Subsequently, by referring to this ON event map, checks can be performed to determine whether individual switches are ON or not.

Specifically, by referring to the ON event map, a check is performed to determine whether the auto track switch 21 is ON or not (step S12). If the auto track switch 21 is found to be ON, an auto track process routine is called (step S13). The details of the auto track process will be described later.

When the auto track process is terminated, or if at step S12 the all to track switch 21 is not ON, a check is then performed to determine whether or not the auto song 1 switch 22 is ON (step S14). When the auto song 1 switch 22 is found to be ON, an auto song 1 process routine is called (step S15). The details of the auto song 1 process will be described later.

When the auto song 1 process is terminated, or if at step S14 the auto song 1 switch 22 is not ON, a check is performed to determine whether or not the auto song 2 switch 23 is ON (step S16). When the auto song 2 switch 23 is found to be ON, an auto song 2 process routine is called (step. S17). The details of the auto song 2 process will be described later.

When the auto song 2 process is terminated, or if at step S16 the auto song 2 switch 23 is not ON, a check is performed to determine whether or not the search switch 24 is ON (step S18). When the search switch 24 is found to be ON, a search process routine is called (step S19).

During the search process, a musical piece identification number that is already recorded is searched for by referring to a recording table as shown in FIG. 9, for example. In the recording table, a "0" is entered for each area, which corresponds to a musical piece identification number, that is not in use, while a "1" is entered for each one that is in use. In agreement with the searched musical piece identification number, the first several measures of a musical piece are reproduced in a search and reproduction process that is performed later (step S29). The details of the search process will be described later.

When the search process is terminated, or if at step S18 the search switch 24 is not ON, a check is performed to determine whether or not the start switch 25 is ON (step S20). When the start switch 25 is found to be ON, a start process routine is called (step S21). The details of the start process will be described later.

When the start process is terminated, or if at step S20 the start switch 25 is not ON, a check is performed to determine whether or not the stop switch 26 is ON (step S22). When the stop switch 26 is found to be ON, a stop process routine is called (step S23). The details of the stop process will be described later.

When the stop process is terminated, or if at step S22 the stop switch 26 is not ON, a check is performed to determine whether or not the operation mode is the reproduction mode (step S24). This check is made by examining the value held by the operation mode flag, which is defined in the RAM 12 (see FIG. 10), to determine whether it is "1" (reproduction mode). If the operation mode is found to be the reproduction mode, the reproduction process is performed (step S25).

In this reproduction process, play data is read from a play data storage sector that corresponds to the musical piece identification number (for a musical piece that is stored in a predetermined area of the RAM 12) that is designated by a predetermined operation, and the read-out play data is sent to an external device via the MIDI interface circuit 13. The external device thereafter produces musical tones.

When the reproduction process is terminated, or if at step S24 the operation mode is not the reproduction mode, a check is performed to determine whether or not the operation mode is a recording mode (step S26). This check is made by examining the value held by the operation mode flag, which is defined in the RAM 12 (see FIG. 10), to determine whether it is "3" (recording mode) or "4" (auto song 2 recording mode). If the operation mode is found to be either recording mode, the recording process is performed (step S27).

In this recording process, play data, which is sent from an external device through the MIDI interface circuit 13, is stored in a storage sector in the RAM 12, which is specified by a musical piece identification number and a track designated through the auto track process, the auto song 1 process, the auto song 2 process, or a predetermined operation.

When the recording process is terminated, or if at step S26 the operation mode is not a recording mode, a check is performed to determine whether or not the operation mode is the search and reproduction mode (step S28). This check is made by examining the value held by the operation mode flag (search and reproduction mode flag), which is defined in the RAM 12, to determine whether it is "2" (search and reproduction mode). If the operation mode is found to be the search and reproduction mode, the search and reproduction process is performed (step S29).

In the search and reproduction process, play data for a musical piece number that is searched for in the search process (step S19) is read from the RAM 12, and is sent to an external device via the MIDI interface circuit 13. In this case, play data for only the first several measures (e.g., two measures) are sent to the external device. Accordingly, musical tones only for the several measures are reproduced.

When the search and reproduction process is terminated, or if at step S28 the operation mode is not the search and reproduction mode, program control loops to step S11 to repeat the switch scan process. By repeating the processes at steps S11 to S29, as described above, the sequencer accomplishes its given functions.

(1) Auto track function

Figure 3:
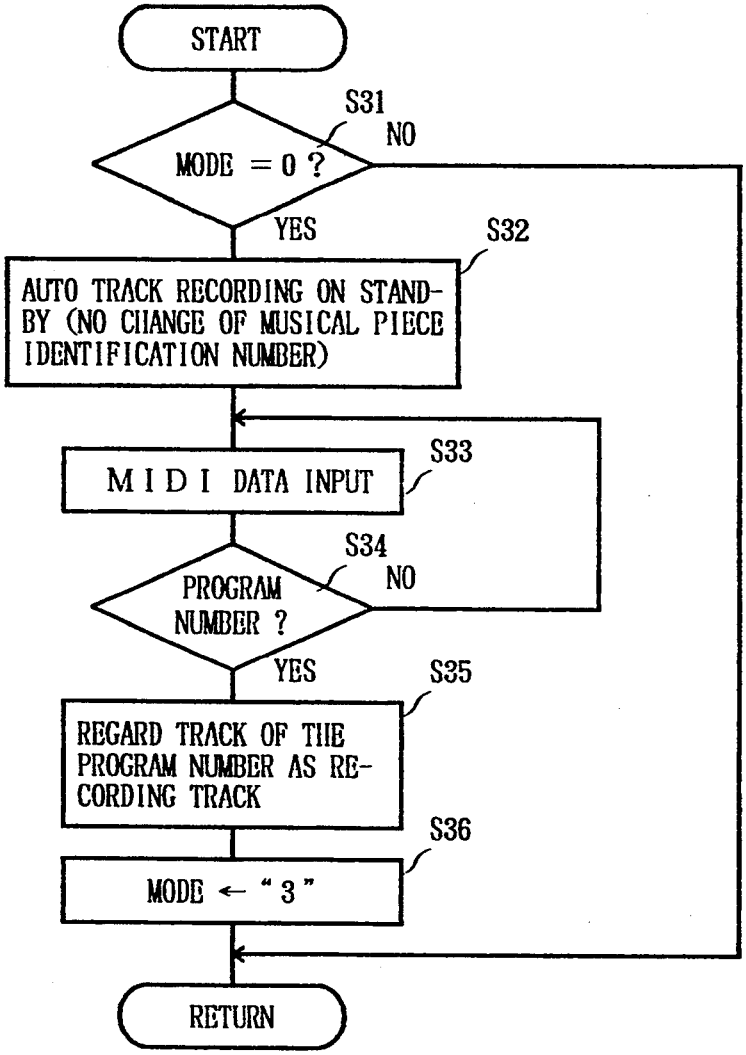
FIG. 3 is a flowchart showing an auto track process in FIG. 2.

The auto track function will now be explained while referring to the flowchart shown in FIG. 3. The auto track function performs automatic selection of a track for recording in a storage sector that corresponds to a musical piece identification number that was previously selected by a predetermined operation.

During the auto track process, first, a check is performed to determine whether the operation mode is "0", i.e., the standby mode (step S31). If the operation mode is not the standby mode, program control returns from the auto track process routine without performing the subsequent sequential processes. That is, the auto track function cannot be used in an operation mode other than the standby mode.

If, at step S31, the operation mode is found to-be the standby mode, auto track recording is then on standby (step S32). A musical piece identification number to be used in this case has previously been selected by switch operations on the operation panel 20, and has been stored in a predetermined area in the RAM 12.

Then, MIDI data is entered (step S33). Specifically, MIDI data is input from an external device via the MIDI interface circuit 13. A check is performed to determine whether the input MIDI data includes program number data (step S34). If the MIDI data does not include program number data, program control returns to step S33, and the above described processes are repeated.

If, following the repeated processes, at step S34 MIDI data is found to include program number data, a track indicated by the value contained in the program number data is regarded as a recording track number (step S35). That is, the value contained in the program number data is temporarily stored in a predetermined area of the RAM 12 to serve as track data that is used in the following recording process (step S27 in FIG. 2).

Sequentially thereafter, the operation mode is set to "3", i.e., a recording mode (step S36), and program control returns from the auto track process routine.

In the above process, when the auto track switch 21 has been depressed, at step S35 a recording track in an area that corresponds to a currently selected musical piece identification number is designated as the storage sector for play data. Recording is performed by storing the MIDI data received from an external device in the storage sector specified by the musical piece identification number and the track.

To record play data, therefore, deliberate selection of a track is not necessary; a track is automatically designated, and recording is begun, by merely selecting a musical piece identification number and depressing the auto track switch 21. Thus, as a user need neither select a track nor remember which tracks are not in use, operation of the sequencer is simple and easy.

In this embodiment, program number data included in the MIDI data is employed to select a track, but other data, such as timbre number data, can also be used to obtain the same effects as in the previously described embodiment.

As it is also possible in this embodiment to select a track in agreement with a timbre number, recording may be initiated by previously assigning a timbre to a track and storing the relevant timbre number data along that track. The externally supplied MIDI data (play data) may then be recorded along the track holding timbre number data that corresponds with its own.

With such an arrangement, a specific, discrete operation is not required during recording to add timbre number data to the head of play data, and accordingly, music can be recorded with a desired timbre and can be reproduced with a desired timbre.

(2) Auto song 1 function

Figure 4:
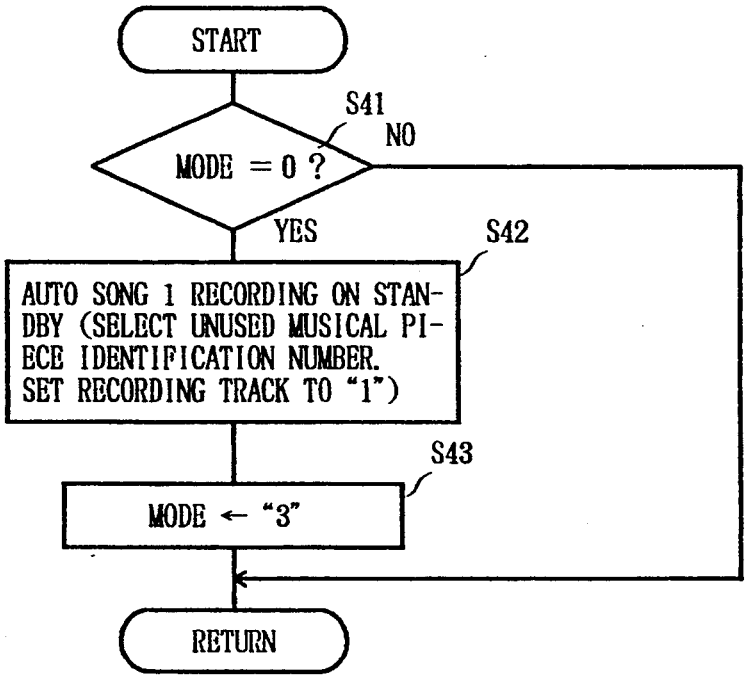
FIG. 4 is a flowchart showing an auto song 1 process in FIG. 2.

The auto song 1 function will now be explained while referring to the flowchart shown in FIG. 4. The auto song 1 function performs automatic selection of the lowest unused musical piece identification number and an arbitrary track to shift to a recording mode.

During the auto song 1 process, first, a check is performed to determine whether the operation mode is "0", i.e., the standby mode (step S41). If the operation mode is not the standby mode, program control returns from the auto song 1 process routine without performing the subsequent sequential processes. That is, the auto song 1 function cannot be performed in an operation mode other than the standby mode.

If, at step S41, the operation mode is found to be the standby mode, auto song 1 recording is then on standby (step S42). Specifically, an unused musical piece identification number is selected, and a "1" is entered to a track where data should be recorded. The selection of a musical piece identification number to be used is performed by referring to the recording table, shown in FIG. 9, that is provided in the RAM 12.

As described above, in the recording table, where each position represents both a track and a musical piece, identification number, a "0" is entered for a track that is not in use, and a "1" is entered for one that is in use. Thus, it is assumed that by beginning at the lowest numbered position and scanning the entries in ascending order, the first "0" encountered represents the lowest unused musical piece identification number, which will later be used for recording.

Subsequently, the operation mode is set to "3", i.e., a recording mode (step S43), and program control returns from the auto song 1 process routine.

In the above process, when the auto song 1 switch 22 has been depressed, recording is performed by storing the MIDI data supplied from an external device along the track in the storage sector, represented by a "1" in the recording table, that corresponds to the lowest musical piece identification number that is currently unused.

To record play data, therefore, the selection of a musical piece identification number and of a track are not necessary, and recording can be initiated in response to a single operation, i.e., the depression of the auto song 1 switch 22. The operation of the sequencer is therefore drastically improved.

In the above embodiment, an explanation has been given for a case where a "1" is entered for a track along which recording will be performed, but a "1" could be entered for a track along which recording will not be performed. Further, the sequencer can be so designed that it employs the method used in the auto track process to automatically select a recording track, and to thus provide the same effect as in the embodiment.

(3) Auto song 2 function

Figure 5:
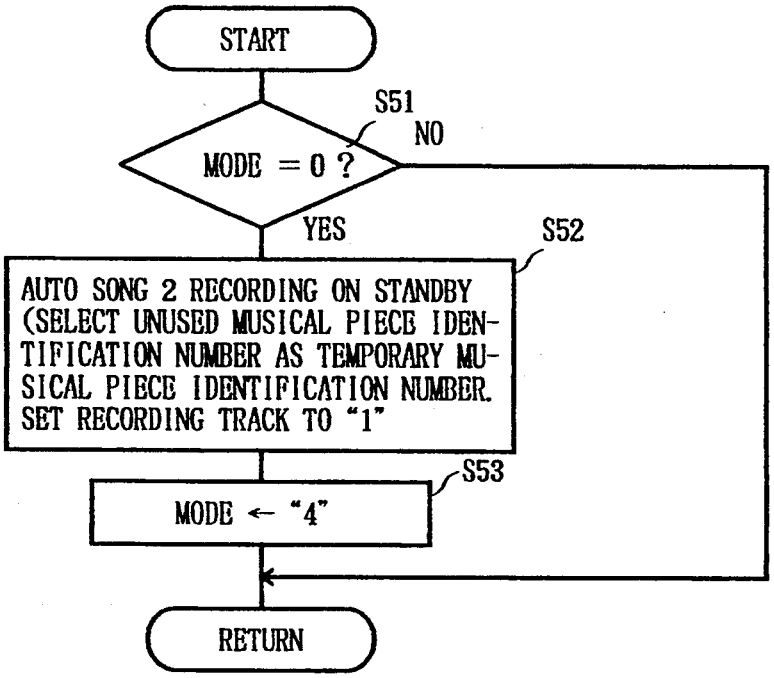
FIG. 5 is a flowchart showing an auto song 2 process in FIG. 2.

The auto song 2 function will now be explained while referring to the flowchart shown in FIG. 5. The auto song 2 function provides for interactive selection of a musical piece identification number and automatically selects a track to shift to in the auto song 2 recording mode. The final selection of a musical piece number is accomplished in a stop process routine to be described later.

During the auto song 2 process, first, a check is performed to determine whether the operation mode is "0", i.e., the standby mode (step S51). If the operation mode is not the standby mode, program control returns from the auto song 2 process routine without performing the subsequent sequential processes. That is, the auto song 2 function cannot be performed in an operation mode other than the standby mode.

If, at step S51, the operation mode is found to be the standby mode, auto song 2 recording is then on standby (step S52). Specifically, an unused musical piece identification number is selected as a temporary musical piece identification number, and a track where data should be recorded is set to "1". The selection of a musical piece identification number to be used is performed by referring to the recording table, shown in FIG. 9, in the same manner as in the previous embodiment.

Sequentially, thereafter, the operation mode is set to "4", i.e., the auto song 2 recording mode (step S53), and program control returns from the auto song 2 process routine. Temporary recording of play data is then performed along the selected track and for the temporary musical piece identification number at step S27 in FIG. 2.

With the above process, when the auto song 2 switch 23 is depressed, recording is performed in a temporary storage sector. Then, in a sequential stop process, unused musical piece identification numbers are displayed, in ascending order beginning with the smallest, on the display device 27 to select a final recording storage sector, as defined by the musical piece identification number.

At this time, when an operator depresses the start switch 25, the musical piece identification number that is currently displayed on the display device 27 is designated, and the MIDI data is transmitted from the temporary storage sector, in which the data has previously been recorded, to the track in the storage sector, represented by a "1" in the recording table, that corresponds to that musical piece identification number. Final recording is thus performed.

Therefore, recording can be started without manually selecting a track and merely by depressing the auto song 2 switch 23. Since recorded musical piece identification numbers can be arbitrarily assigned in an interactive mode, an operator can arrange musical piece identification numbers as he wants. Thus a sequencer with improved operations can be provided.

In the above embodiment, an explanation has been given for a case where a "1" is employed for a track along which recording will be performed, but a "1" could be entered for a track along which recording will not be performed. Further, the sequencer can be so designed that it employs the method used in the auto track process to automatically select a recording track, and to thus provide the same effect as in the embodiment.

(4) Search function

Figure 6:
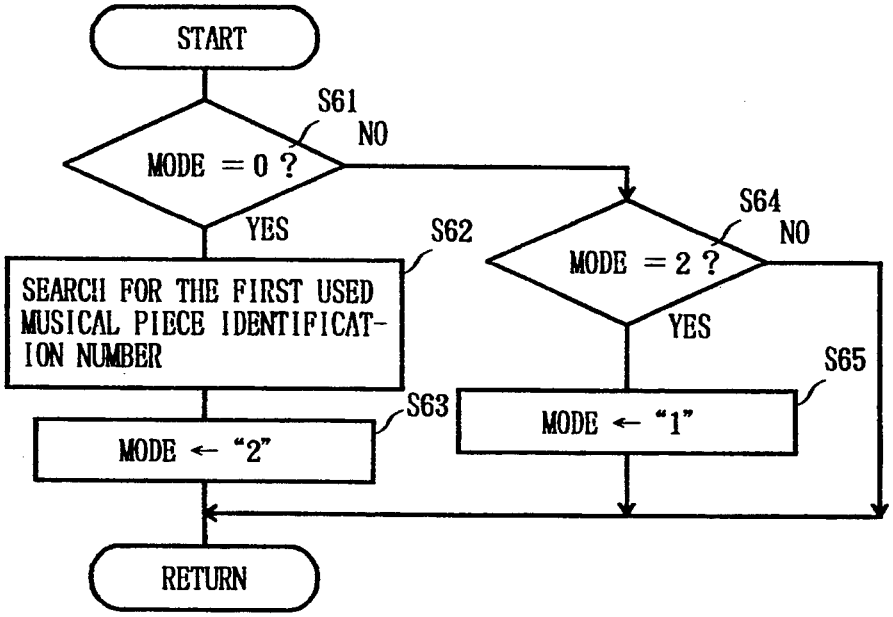
FIG. 6 is a flowchart showing a search process in FIG. 2.

The search function will now be explained while referring to the flowchart shown in FIG. 6. The search function searches for previously recorded musical pieces and reproduces several measures of each of them in a predetermined order.

In the search process, first, a check is performed to determine whether or not the operation mode is "0", i.e., the standby mode (step S61). When the operation mode is found to be the standby mode, the musical piece identification number for the first recorded musical piece is searched for (step S62). This search is performed by referring to the recording table shown in FIG. 9. The musical piece identification number for the first recorded musical piece that is found is then stored in a predetermined area in the RAM 12.

Then, the operation mode is set to "2", i.e., a search and reproduction mode (step S63), and program control returns from the search process routine. In the search and reproduction process (step S29 in FIG. 2) that is sequentially performed, therefore, several measures of a musical piece that is identified by the musical piece identification number stored in the predetermined area of the RAM 12 is reproduced.

If, at step S61, the operation mode is not the standby mode, a check is performed to determine whether or not the operation mode is "2", i.e., whether search and reproduction are in progress (step S64). When search and reproduction are found to be in progress, the operation mode is set to "1", i.e., to a normal reproduction mode (step S65). Program control then returns from the search process.

This means that the search switch 24 has been depressed in the search and reproduction mode, i.e., that an operator has selected a musical piece for which several measures are being reproduced. As a result, a normal reproduction process will be performed (step S25 in FIG. 2) and the whole music piece will be reproduced.

If, at step S64, search and reproduction are not in progress, program control returns from the search process routine without performing the subsequent sequential processes.

As described above, when the search switch 24 is depressed, the operation mode is shifted to the search and reproduction mode, and the recorded musical pieces are sequentially read and several measures of each are reproduced in order. When a desired musical piece appears during search and reproduction, and an operator again depresses the search switch 24, normal reproduction is performed for that musical piece.

Unlike a conventional sequencer, therefore, it is not necessary to repeatedly select musical piece identification numbers and sample their corresponding musical pieces, and it is easy to find a desired musical piece.

(5) Start process

Figure 7:
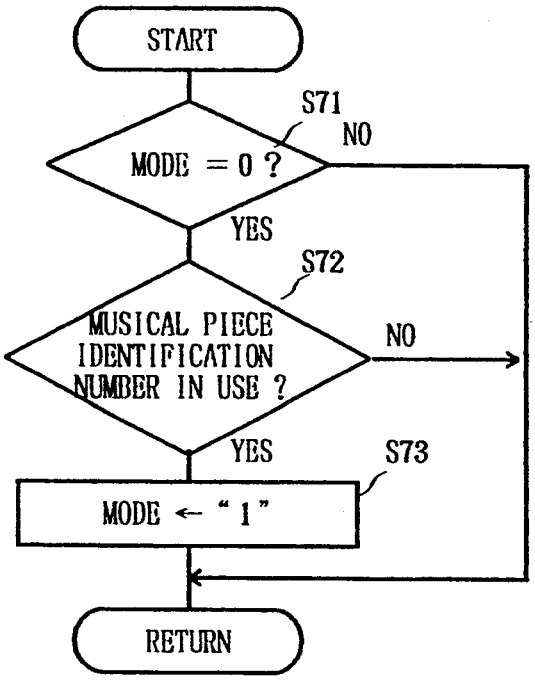
FIG. 7 is a flowchart showing a start process in FIG. 2.
Figure 8:
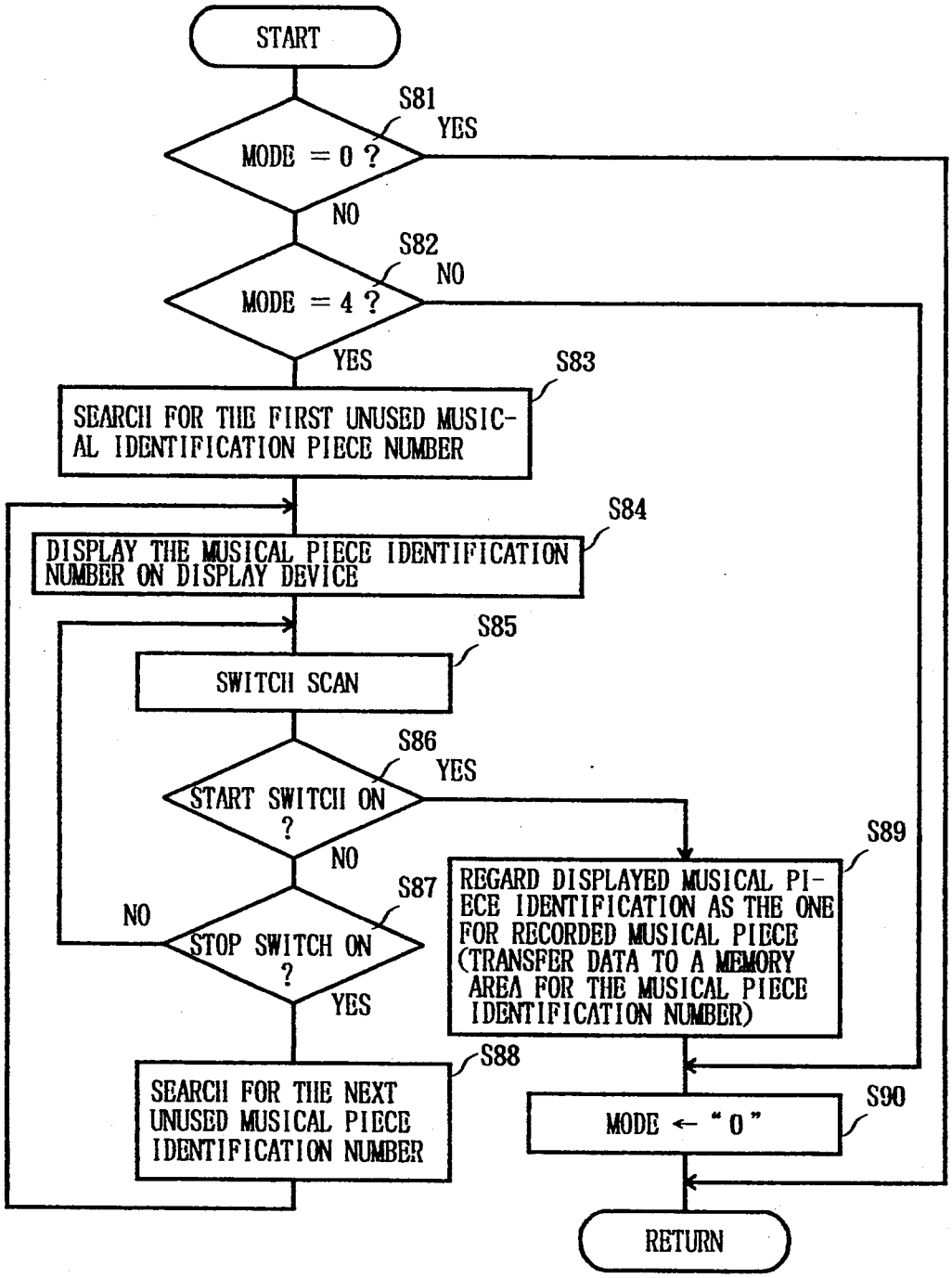
FIG. 8 is a flowchart showing a stop process in FIG. 2.

The start process will now be explained while referring to the flowchart shown in FIG. 7.

In the start process, first, a check is performed to determine whether or not the operation mode is "0", i.e., the standby mode (step S71). If the operation mode is not the standby mode, program control returns from the start process routine without performing the subsequent sequential processes. This means that the start switch 25 does not work in an operation mode other than the standby mode.

If, at step S71, the operation mode is the standby mode, a check is performed to determine whether or not, at the time of the depression of the start switch 25, a musical piece identification number, that is stored in a predetermined area in the RAM 12 during the search process, is in use (step S72). This determination is performed by referring to the recording table shown in FIG. 9.

If the musical piece is found to have been recorded, the operation mode is set to "1", i.e., a normal reproduction mode, and program control returns from the start process routine. In a subsequent reproduction process (step S25 in FIG. 2), play data, which corresponds to a musical piece identification number stored in a predetermined area in the RAM 12, is read out, and normal, reproduction is performed (6) Stop process The stop process will now be described while referring to the flowchart in FIG. 8.

In this process, first, a check is performed to determine whether or not the operation mode is "0", i.e., the standby mode (step S81). When the operation mode is found to be the standby mode, program control returns from the stop process routine without performing the sequential processes. This means that the stop switch 26 is not valid in the standby mode.

If, at step S81, the operation mode is not the standby mode, a check is performed to determine whether or not the operation mode is "4", i.e., whether or not auto song 2 recording is in progress (step S82). When auto song 2 recording is not in progress, the operation mode is set to "0", i.e., the standby mode (step S90). Program control then returns from the stop process routine, that is, a normal stop process will be performed.

If, at step S82, auto song 2 recording is found to be in progress, the first unused musical piece identification number is searched for (step S83). This search is performed by referring to the recording table shown in FIG. 9. After the search, the first unused musical piece identification number found is displayed on the display device 27 of the operation panel 20 (step S84).

Then, a switch scan process is performed (step S85). (As this switch scan process is the same as the one at step S11 in FIG. 2, it is not explained here.) A check is then performed to determine whether or not the start switch 25 has been depressed (step S86).

If the start switch 25 is found to have been depressed, program control branches to step S89 where a musical piece identification number currently displayed on the display device 27 is regarded as a musical piece identification number for a musical piece that has been recorded by the auto song 2 function. Play data (stored in a temporary storage sector) that corresponds to that musical piece identification number is transmitted to a corresponding storage sector in the RAM 12. As a result, auto song 2 recording function is accomplished.

Sequentially, the operation mode is set to "0", i.e., the standby mode (step S90), and program control returns from the stop process routine.

If, at step S86, the start switch 25 has not been depressed, a check is performed to determine whether or not the stop switch 26 has been depressed (step S87). When the stop switch 26 has not been depressed, program control returns to step S85 and repeats the same processes. That is, the program loops until either the stop switch 25 or the stop switch 26 is depressed.

During this iteration, if, at step S87, the stop switch 26 is found to have been depressed, the next unused musical piece identification number is searched for (step S88). Program control then returns to step S84 where that musical piece identification number is displayed on the display device 27.

Through the above process, since one of the unused musical piece, numbers, presented in ascending order, is displayed upon each depression of the stop switch 26, an operator can assign externally received data to a desired musical piece identification number by merely depressing the start switch 25 when that musical piece identification number is displayed.

In the above embodiment, an explanation has been given for a case where RAM is used for storing play data, but usable memory is not limited to RAM. The memory used can be any type of a rewritable storage medium, such as a floppy disk and a magnetic tape, which provides the same effect as in the embodiment.

As described above in detail, according to the present invention, it is possible to provide a highly efficient sequencer that requires only a simple operation to select a location for recording play data.

Also, it is possible to provide a sequencer that requires only a simple operation to search for a desired musical piece for reproduction.

What is claimed is:

1. A sequencer comprising:

interface means for receiving play data from an external device and for transmitting said play data to a predetermined device;

instructing means for generating a signal indicating a recording start;

said instructing means including predetermined data;

said predetermined data being supplied independently of operator-controlled panel switches;

said predetermined device being a control means, connected to said interface means and said instructing means, for, upon reception from said instructing means of said signal, using said predetermined data to generate and output data designating a storage location for said play data and for outputting said play data; and storage means, connected to said control means, for storing said play data output by said control means;

said storage means including multiple storage areas each storage area of said multiple storage areas being identified by a unique identification number;

said play data being automatically assigned to a specifically numbered storage area in said storage means to facilitate automatic retrieval of said play data;

said automatic assigning of play data supplanting panel switches otherwise required to be operated by an operator of said sequencer.

2. A sequencer according to claim 1, wherein said play data received via said interface means is play data formatted in accordance with the industry standards for MIDI.

3. A sequencer according to claim 1, wherein said control means has a CPU.

4. A sequencer according to claim 1, wherein, based on program number data included in said play data, said control means automatically generates data for a storage location for said play data received from said interface means, and outputs said storage location data.

5. A sequencer according to claim 1, wherein, based on timbre number data included in said play data, said control means automatically generates data for a storage location for said play data received from said interface means, and outputs said storage location data.

6. A sequencer according to claim 1, wherein said data for a storage location for play data, received from said control means, consist of musical piece identification number data and track data.

7. A sequencer according to claim 6, wherein said control means automatically generates said track data as data for a storage location for play data.

8. A sequencer according to claim 6, wherein said control means automatically generates said musical piece identification number data and said track data as data for a storage location for play data.

9. A sequencer according to claim 1, wherein said control means has a table which is used to control unused areas in said storage means, and decides on a storage location for play data received from said interface means in accordance with the contents of said table.

10. A sequencer according to claim 9, further comprising selecting means for selecting one of said unused areas in said storage means by using said table, wherein said control means uses said selection by said selecting means to decide on a storage location for said play data received from said interface means, and generates said storage location data.

11. A sequencer, comprising:

storage means for storing play data corresponding to multiple musical pieces;

instructing means for generating a first and a second signal indicating continuous reproduction;

control means, connected to said storage means and said instructing means, for, upon reception from said instructing means of said first signal, sequentially reading a first predetermined quantity of said play data from a head of each of said multiple musical pieces until the desired musical piece is located, and outputting said first predetermined quantity of the play data of the desired musical piece, and for, upon reception from said instructing means of said second signal, reading and outputting a second predetermined quantity of said play data of said desired musical piece, said second predetermined quantity being a remainder of said play data of said desired musical piece; and interface means, connected to said control means, for transmitting said play data to an external device;

whereby automatic retrieval of said play data is quickly accomplished;

said automatic retrieval supplanting panel switches otherwise required to be operated by an operator of said sequencer.

12. A sequencer according to claim 11, wherein said play data received via said interface means is play data formatted in accordance with the industry standards for MIDI.

13. A sequencer according to claim 11, wherein said control means has a CPU.

14. A sequencer according to claim 11, wherein said play data received via said interface means is play data formatted in accordance with the industry standards for MIDI.

15. A sequencer according to claim 11, wherein said control means has a CPU.

16. A sequencer comprising:

a control means;

an interface means for receiving play data from an external device and transmitting said play data from said external device to said control means;

said play data including data designating a timbre number, said data designating a timbre number being supplied to said play data independently of panel switch manipulation;

instructing means for generating a signal indicating a recording start and for generating data designating a unique storage location based upon said data designating a timbre number;

said control means outputting said play data designating a timbre number and sequentially outputting said play data; and storage means, connected to said control means, for storing said play data transmitted by said control means for designating a timbre, and said play data transmitted by said interface means, based on said data designating a storage location transmitted by said control means;

whereby said data designating a timbre number need not be designated by manipulation of a panel switch prior to recording said play data.

* * * * *

UNITED STATES PATENT AND TRADEMARK OFFICE

CERTIFICATE OF CORRECTION

PATENT NO. : 5,403,965

DATED : April 4, 1995

INVENTOR(S) : Tatsuya Matsuda, Toshinori Matsuda

It is certified that error appears in the above-indentified patent and that said Letters Patent is hereby corrected as shown below:

On title page, item [75]: "Tasuya" should be --Tatsuya--

Column 14, line 32, "14" should be --15--, and "11" should be --14--.

Column 14, line 36, "15" should be --16--, and "11" should be --14--.

Column 14, line 38, "16" should be --14--.

Signed and Sealed this

Fifth Day of December, 1995

*Attest:*

*Attesting Officer*

Bruce Lehman

BRUCE LEHMAN

*Commissioner of Patents and Trademarks*